US008015011B2

(12) United States Patent
Nagano et al.

(10) Patent No.: US 8,015,011 B2
(45) Date of Patent: Sep. 6, 2011

(54) GENERATING OBJECTIVELY EVALUATED SUFFICIENTLY NATURAL SYNTHETIC SPEECH FROM TEXT BY USING SELECTIVE PARAPHRASES

(75) Inventors: Tohru Nagano, Yokohama (JP); Masafumi Nishimura, Yokohama (JP); Ryuki Tachibana, Yokohama (JP)

(73) Assignee: Nuance Communications, Inc., Burlington, MA (US)

( * ) Notice: Subject to any disclaimer, the term of this patent is extended or adjusted under 35 U.S.C. 154(b) by 890 days.

(21) Appl. No.: 12/022,333

(22) Filed: Jan. 30, 2008

(65) Prior Publication Data

US 2008/0183473 A1 Jul. 31, 2008

(30) Foreign Application Priority Data

Jan. 30, 2007 (JP) ..... 2007-019433

(51) Int. Cl.
*G10L 13/08* (2006.01)
*G10L 13/06* (2006.01)

(52) U.S. Cl. ..... 704/260; 704/267; 704/258

(58) Field of Classification Search ..... None
See application file for complete search history.

(56) References Cited

U.S. PATENT DOCUMENTS

| | | | | |
|---|---|---|---|---|
| 5,794,188 | A * | 8/1998 | Hollier | 704/228 |
| 6,035,270 | A * | 3/2000 | Hollier et al. | 704/202 |
| 6,366,883 | B1 * | 4/2002 | Campbell et al. | 704/260 |
| 6,665,641 | B1 * | 12/2003 | Coorman et al. | 704/260 |
| 7,024,362 | B2 * | 4/2006 | Chu et al. | 704/260 |
| 7,386,451 | B2 * | 6/2008 | Chu et al. | 704/260 |
| 7,567,896 | B2 * | 7/2009 | Coorman et al. | 704/10 |
| 2003/0028380 | A1 * | 2/2003 | Freeland et al. | 704/260 |
| 2003/0154081 | A1 * | 8/2003 | Chu et al. | 704/266 |
| 2006/0004577 | A1 * | 1/2006 | Nukaga et al. | 704/267 |
| 2006/0224391 | A1 * | 10/2006 | Tamura et al. | 704/268 |
| 2007/0192105 | A1 * | 8/2007 | Neeracher et al. | 704/258 |
| 2008/0059190 | A1 * | 3/2008 | Chu et al. | 704/258 |

FOREIGN PATENT DOCUMENTS

JP 2003-131679 9/2003

OTHER PUBLICATIONS

Hamza, et al, "Reconciling Pronunciation Differences Between the Frontend and Back-End in the IBM Speech Synthesis Systems", Oct. 2004, ICSLP, Jeju, South Korea.

* cited by examiner

*Primary Examiner* — Talivaldis Ivars Smits
(74) *Attorney, Agent, or Firm* — Wold, Greenfield & Sacks, P.C.

(57) ABSTRACT

A synthetic speech system includes a phoneme segment storage section for storing multiple phoneme segment data pieces; a synthesis section for generating voice data from text by reading phoneme segment data pieces representing the pronunciation of an inputted text from the phoneme segment storage section and connecting the phoneme segment data pieces to each other; a computing section for computing a score indicating the unnaturalness of the voice data representing the synthetic speech of the text; a paraphrase storage section for storing multiple paraphrases of the multiple first phrases; a replacement section for searching the text and replacing with appropriate paraphrases; and a judgment section for outputting generated voice data on condition that the computed score is smaller than a reference value and for inputting the text after the replacement to the synthesis section to cause the synthesis section to further generate voice data for the text.

12 Claims, 8 Drawing Sheets

| NOTATION | A | I | .... |
|---|---|---|---|
| SPEECH WAVEFORM DATA | 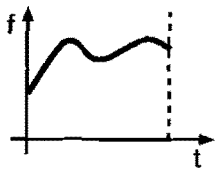  | 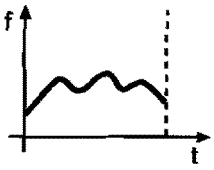  | .... |
| TONE DATA | FRONT-END: 3.25, 4.5, 0, 1.2, 3<br>BACK-END: 3.05, 4, 0.1, 1.25, 3.5 | FRONT-END: 2, 1, 6.5, 3, 2<br>BACK-END: 1.9, 1.1, 6.3, 3.2, 2.1 | .... |
20
FIG. 2

| FIRST NOTATION | SECOND NOTATION | DEGREE OF SIMILARITY |
|---|---|---|
| bokuno *(my)* | watasino *(my)* | 65% |
| soba *(near)* | tikaku *(near)* | 75% |
| dehurosuta *(defroster)* | dehurosutâ *(defroster)* | 90% |
| kureyo *(please)* | chôdai *(please)* | 45% |
| defurostâ *(defroster)* | dehoggâ *(defogger)* | 55% |
| ⋮ | ⋮ | ⋮ |

340

400

| TEXT ID | TEXT | SCORE | SYNTHETIC SPEECH DATA |
|---|---|---|---|
| 1 (INPUTTED TEXT) | bokuno sobano madono dehurosuta o tukete kureyo *(turn on the defrosting of my window)* | 0.79974 | E:¥Voice¥doc¥ patent¥paraphrasing |
| 2 | bokuno sobano madono dehurosutâ o tukete kureyo *(turn on the defroster of my window)* | 0.761916 | E:¥Voice¥doc¥ patent¥paraphrasing |
| 3 | bokuno tikakuno madono dehurosutâ o tukete kureyo *(turn on the defroster of my closest window)* | 0.751579 | E:¥Voice¥doc¥ patent¥paraphrasing |
| 4 | watasino tikakuno madono dehurosutâ o tukete kureyo *(turn on the defroster of the window closest to me)* | 0.691753 | E:¥Voice¥doc¥ patent¥paraphrasing |
| 5 | watasino tikakuno madono dehurosutâ o tukete chôdai *(Let's turn on the defroster of the window closest to me)* | 0.64809 | E:¥Voice¥doc¥ patent¥paraphrasing |
| 6 | watasino tikakuno madono dehurosutâ o tukete kudasai *(Please turn on the defroster of the window closest to me)* | 0.630847 | E:¥Voice¥doc¥ patent¥paraphrasing |
| 7 | watasino tikakuno madono, dehurosutâ o tukete kudasai *(Please turn on, the defroster of the window closest to me)* | 0.583045 | E:¥Voice¥doc¥ patent¥paraphrasing |
| 8 OUTPUT | watasino tikakuno madono, dehoggâ o tukete kudasai *(Please turn on, the defogger of the window closest to me)* | 0.544953 | E:¥Voice¥doc¥ patent¥paraphrasing |

FIG. 8

GENERATING OBJECTIVELY EVALUATED SUFFICIENTLY NATURAL SYNTHETIC SPEECH FROM TEXT BY USING SELECTIVE PARAPHRASES

FIELD OF THE INVENTION

The present invention relates to a technique of generating synthetic speech, and in particular to a technique of generating synthetic speech by connecting multiple phoneme segments to each other.

BACKGROUND OF THE INVENTION

For the purpose of generating synthetic speech that sounds natural to a listener, a speech synthesis technique employing a waveform editing and synthesizing method has been used heretofore. In this method, a speech synthesizer apparatus records human speech and waveforms of the speech are stored as speech waveform data in a data base, in advance. Then, the speech synthesizer apparatus generates synthetic speech, also referred to as synthesized speech, by reading and connecting multiple speech waveform data pieces in accordance with an inputted text. It is preferable that the frequency and tone of speech continuously change in order to make such synthetic speech sound natural to a listener. For example, when the frequency and tone of speech largely changes in a part where speech waveform data pieces are connected to each other, the resultant synthetic speech sounds unnatural.

However, there is a limitation on types of speech waveform data that are recorded in advance because of cost and time constraints, and limitations of the storage capacity and processing performance of a computer. For this reason, in some cases, a substitute speech waveform data piece is used instead of the proper data piece to generate a certain part of the synthesized speech since the proper data piece is not registered in the database. This may consequently cause the frequency and the like in the connected part to change so much that the synthesized speech sounds unnatural. This case is more likely to happen when the content of inputted text is largely different from the content of speech recorded in advance for generating the speech waveform data pieces.

A speech output apparatus disclosed in Japanese Patent Application Laid-open Publication No. 2003-131679 makes a text more understandable to a listener by converting the text composed of phrases in a written language into a text in a spoken language, and then by reading the resultant text aloud. However, this apparatus is only for converting the expression of a text from the written language to the spoken language, and this conversion is performed independently of information on frequency changes and the like in speech wave data. Accordingly, this conversion does not contribute to a quality improvement of synthetic speech, itself. In a technique described in Wael Hamza, Raimo Bakis, and Ellen Eide, "RECONCILING PRONUNCIATION DIFFERENCES BETWEEN THE FRONT-END AND BACK-END IN THE IBM SPEECH SYNTHESIS SYSTEM," Proceedings of ICSLP, Jeju, South Korea, 2004, pp. 2561-2564, multiple phonemes that are pronounced differently but written in the same manner are stored in advance, and an appropriate phoneme segment among the multiple phoneme segments is selected so that the synthesized speech can be improved in quality. However, even by making such a selection, the resultant syntheized speech sounds unnatural if an appropriate phoneme segment is not included in those stored in advance.

SUMMARY OF THE INVENTION

A first aspect of the present invention is to provide a system for generating synthetic speech including a phoneme segment storage section, a synthesis section, a computing section, a paraphrase storage section, a replacement section and a judgment section. More precisely, the phoneme segment storage section stores a plurality of phoneme segment data pieces indicating sounds of phonemes different from each other. The synthesis section generates voice data representing synthetic speech of the text by receiving inputted text, by reading the phoneme segment data pieces corresponding to the respective phonemes indicating the pronunciation of the inputted text, and then by connecting the read-out phoneme segment data pieces to each other. The computing section computes a score indicating the unnaturalness (or naturalness) of the synthetic speech of the text, on the basis of the voice data. The paraphrase storage section stores a plurality of second notations that are paraphrases of a plurality of first notations while associating the second notations with the respective first notations. The replacement section searches the text for a notation matching with any of the first notations and then replaces the searched-out notation with the second notation corresponding to the first notation. On condition that the computed score is smaller than a predetermined reference value, the judgment section outputs the generated voice data. In contrast, on condition that the score is equal to or greater than the reference value, the judgment section inputs the text to the synthesis section in order for the synthesis section to further generate voice data for the text after the replacement. In addition to the system, provided are a method for generating synthetic speech with this system and a program causing an information processing apparatus to function as the system.

Note that the aforementioned outline of the present invention is not an enumerated list of all of the features necessary for the present invention. Accordingly, the present invention also includes a sub-combination of these features.

BRIEF DESCRIPTION OF THE DRAWINGS

For a more complete understanding of the present invention and the advantages thereof, reference is now made to the following description taken in conjunction with the accompanying drawings.

FIG. 2 shows an example of a data structure of a phoneme segment storage section 20.

FIG. 8 shows specific examples of texts sequentially generated in a process of generating a synthetic speech by the speech synthesizer system 10.

DETAILED DESCRIPTION OF THE PREFERRED EMBODIMENT

Hereinafter, the present invention will be described by using an embodiment. However, the following embodiment does not limit the invention recited in the scope of claims.

Moreover, all the combinations of features described in the embodiment are not necessarily essential for solving means of the invention.

Figure 1:
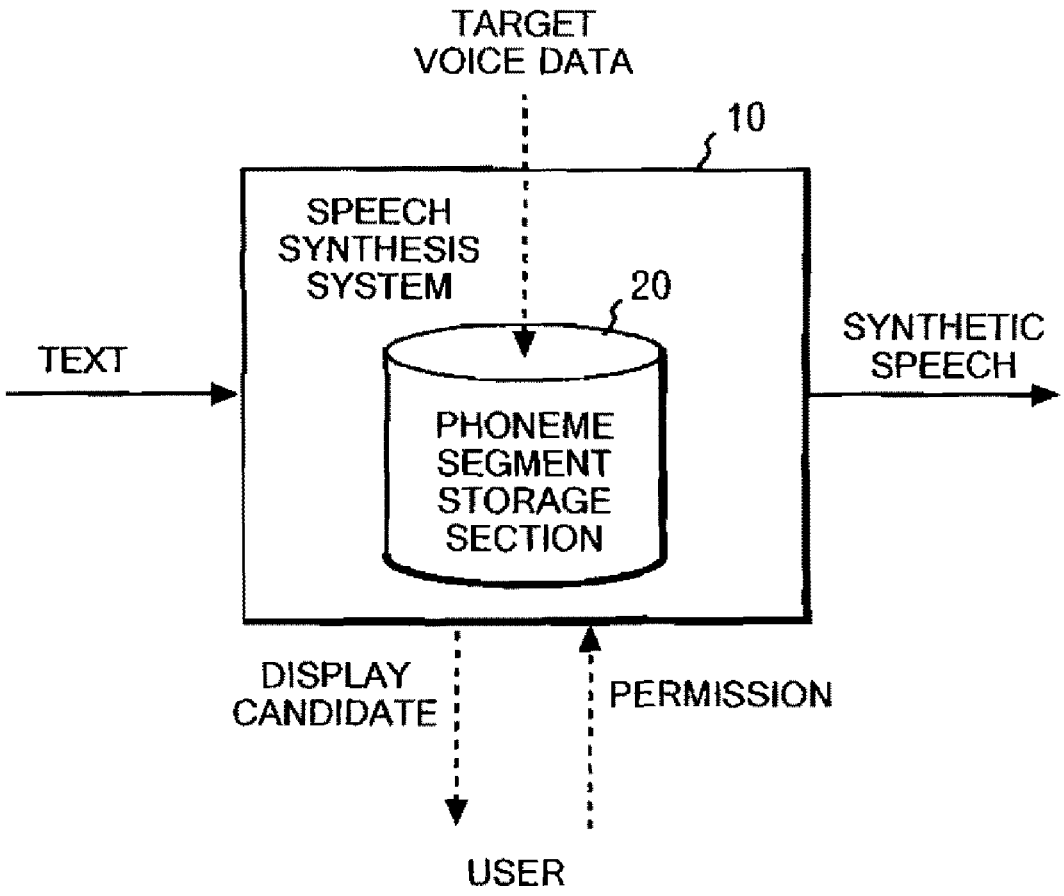
FIG. 1 shows an entire configuration of a speech synthesizer system 10 and data related to the system 10.

FIG. 1 shows an entire configuration of a speech synthesizer system 10 and data related to the system 10. The speech synthesizer system 10 includes a phoneme segment storage section 20 in which a plurality of phoneme segment data pieces are stored. These phoneme segment data pieces are generated in advance by dividing target voice data by data piece for each phoneme, and the target voice data are data representing the announcer's speech that is a target to be generated. The target voice data are data obtained by recording a speech which an announcer, for example, makes in reading aloud a script, and the like. The speech synthesizer system 10 receives input of a text, processes the inputted text through a morphological analysis, an application of prosodic models and the like, and thereby generates data pieces on a prosody, a tone and the like of each phoneme to be generated as speech data made by reading the text aloud. Thereafter, the speech synthesizer system 10 selects and reads multiple phoneme segment data pieces from the phoneme segment storage section 20 according to the generated data pieces on frequency and the like, and then connects these read phoneme segment data pieces to each other. The multiple phoneme segment data pieces thus connected are outputted as voice data representing the synthetic speech of the text on condition that a user permits the output.

Here, types of phoneme segment data that can be stored in the phoneme segment storage section 20 are limited due to constraints of costs and required time, the computing capability of the speech synthesizer system 10 and the like. For this reason, even when the speech synthesizer system 10 figures out a frequency to be generated as a pronunciation of each phoneme as a result of the processing, such as the application of the prosodic models, the phoneme segment data piece on the frequency may not be stored in the phoneme segment storage section 20 in some cases. In this case, the speech synthesizer system 10 may select an inappropriate phoneme segment data piece for this frequency, thereby resulting in the generation of synthetic speech with low quality. To prevent this, the speech synthesizer system 10 according to a preferred embodiment aims to improve the quality of outputted synthetic speech by paraphrasing a notation in a text in a way that its meaning would not be changed, when voice data once generated has only insufficient quality.

FIG. 2 shows an example of a data structure of the phoneme segment storage section 20. The phoneme segment storage section 20 stores multiple phoneme segment data pieces representing the sounds of phonemes which are different from one another. Precisely, the phoneme segment storage section 20 stores the notation, the speech waveform data and the tone data of each phoneme. For example, the phoneme segment storage section 20 stores, as the speech waveform data, information indicating an over-time change in a fundamental frequency for a certain phoneme having the notation "A." Here, the fundamental frequency of a phoneme is a frequency component that has the greatest volume of sound among the frequency components constituting the phoneme. In addition, the phoneme segment storage section 20 stores, as tone data, vector data for a certain phoneme having the same notation "A," the vector data indicating, as an element, the volume or intensity of sound of each of multiple frequency components including the fundamental frequency. FIG. 2 illustrates the tone data at the front-end and back-end of each phoneme for convenience of explanation, but the phoneme segment storage section 20 stores, in practice, data indicating an over-time change in the volume or intensity of sound of each frequency component.

In this way, the phoneme segment storage section 20 stores the speech waveform data piece of each phoneme, and accordingly, the speech synthesizer system 10 is able to generate speech having multiple phonemes by connecting the speech waveform data pieces. Incidentally, FIG. 2 shows only one example of the contents of the phoneme segment data, and thus the data structure and data format of the phoneme segment data stored in the phoneme segment storage section 20 are not limited to those shown in FIG. 2. In another example, the phoneme segment storage section 20 may directly store recorded phoneme data as the phoneme segment data, or may store data obtained by performing certain arithmetic processing on the recorded data. The arithmetic processing is, for example, the discrete cosine transform and the like. Such processing enables a reference to a desired frequency component in the recorded data, so that the fundamental frequency and tone can be analyzed.

Figure 3:
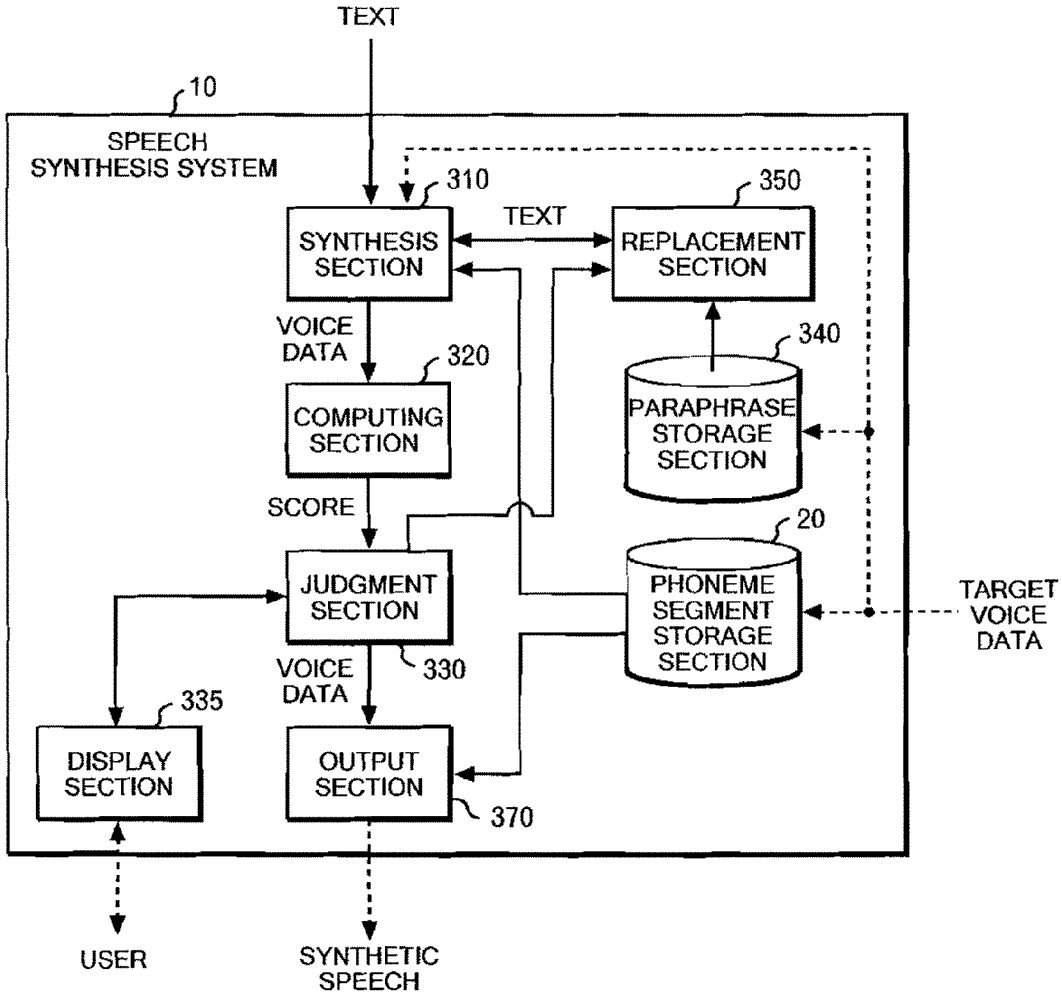
FIG. 3 shows a functional configuration of the speech synthesizer system 10.

FIG. 3 shows a functional configuration of the speech synthesizer system 10. The speech synthesizer system 10 includes the phoneme segment storage section 20, a synthesis section 310, a computing section 320, a judgment section 330, a display section 335, a paraphrase storage section 340, a replacement section 350 and an output section 370. To begin with, the relationships between these sections and hardware resources will be described. The phoneme segment storage section 20 and the paraphrase storage section 340 can be implemented by memory devices such as a RAM 1020 and a hard disk drive 1040, which will be described later. The synthesis section 310, the computing section 320, the judgment section 330 and the replacement section 350 are implemented through operations by a CPU 1000, which also will be described later, in accordance with commands of an installed program. The display section 335 is implemented not only by a graphic controller 1075 and a display device 1080, which also will be described later, but also a pointing device and a keyboard for receiving inputs from a user. In addition, the output section 370 is implemented by a speaker and an input/output chip 1070.

The phoneme segment storage section 20 stores multiple phoneme segment data pieces as described above. The synthesis section 310 receives a text inputted from the outside, reads, from the phoneme segment storage section 20, the phoneme segment data pieces corresponding to the respective phonemes representing the pronunciation of the inputted text, and connects these phoneme segment data pieces to each other. More precisely, the synthesis section 310 firstly performs a morphological analysis on this text, and thereby detects boundaries between words and a part-of-speech of each word. Next, on the basis of pre-stored data on how to read aloud each word (referred to as a "reading way" below), the synthesis section 310 finds which sound frequency and tone should be used to pronounce each phoneme when this text is read aloud. Thereafter, the synthesis section 310 reads the phoneme segment data pieces close to the found-out frequency and tone, from the phoneme segment storage section 20, connects the data pieces to each other, and outputs the connected data pieces to the computing section 320 as the voice data representing the synthetic speech of this text.

The computing section 320 computes a score indicating the unnaturalness of the synthetic speech of this text, based on the voice data received from the synthesis section 310. This score indicates the degree of difference in the pronunciation, for example, between first and second phoneme segment data pieces contained in the voice data and connected to each other, at the boundary between the first and second phoneme segment data pieces. The degree of difference between the pronunciations is the degree of difference in the tone and fundamental frequency. In essence, as a greater degree of difference results in a sudden change in the frequency and the like of speech, the resultant synthetic speech sounds unnatural to a listener.

The judgment section 330 judges whether or not this computed score is smaller than a predetermined reference value. On condition that this score is equal to or greater than the reference value, the judgment section 330 instructs the replacement section 350 to replace notations in the text for the purpose of generating new voice data of the text after the replacement. On the other hand, on condition that this score is smaller than the reference value, the judgment section 330 instructs the display section 335 to show a user the text for which the voice data have been generated. Thus, the display section 335 displays a prompt asking the user whether or not to permit the generation of the synthetic speech based on this text. In some cases, this text is inputted from the outside without any modification, or in other cases, the text is generated as a result of the replacement processing performed by the replacement section 350 several times.

On condition that an input indicating the permission of the generation is received, the judgment section 330 outputs the generated voice data to the output section 370. In response to this, the output section 370 generates the synthetic speech based on the voice data, and outputs the synthetic speech for the user. On the other hand, when the score is equal to or greater than the reference value, the replacement section 350 receives an instruction from the judgment section 330 and then starts the processing. The paraphrase storage section 340 stores multiple second notations that are paraphrases of multiple first notations while associating the second notations with the respective first notations. Upon receipt of the instruction from the judgment section 330, the replacement section 350 firstly obtains, from the synthesis section 310, the text for which the previous speech synthesis has been performed. Next, the replacement section 350 searches the notations in the obtained text for a notation matching with any of the first notations. On condition that the notation is searched out, the replacement section 350 replaces the searched-out notation with the second notation corresponding to the matching first notation. After that, the text having the replaced notation is inputted to the synthesis section 310, and then new voice data is generated based on the text.

Figures 4, 5:
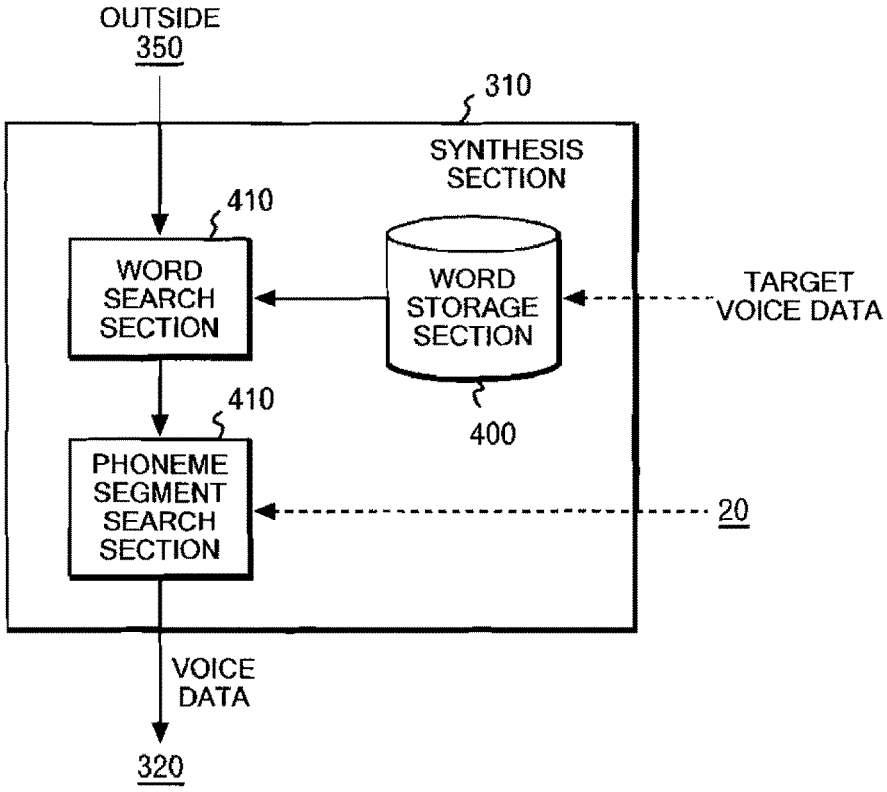
FIG. 4 shows a functional configuration of a synthesis section 310.
FIG. 5 shows an example of a data structure of a paraphrase storage section 340.

FIG. 4 shows a functional configuration of the synthesis section 310. The synthesis section 310 includes a word storage section 400, a word search section 410 and a phoneme segment search section 420. The synthesis section 310 generates a reading way of the text by using a method known as an n-gram model, and then generates voice data based on the reading way. More precisely, the word storage section 400 stores a reading way of each of multiple words previously registered, while associating the reading way with the notation of the word. The notation is composed of a character string constituting a word/phrase, and the reading way is composed of, for example, a symbol representing a pronunciation, a symbol of an accent or an accent type. The word storage section 400 may store multiple reading ways which are different from each other for the same notation. In this case, for each reading way, the word storage section 400 further stores a value of the probability that the reading way is used to pronounce the notation.

To be more precise, for each of combinations of a predetermined number of words (for example, a combination of two words in the bi-gram model), the word storage section 400 stores a value of the probability that the combination of words is pronounced by using each combination of reading ways. For example, in terms of a single word of "bokuno (my)," the word storage section 400 stores not only the values of both the probabilities of pronouncing the word with the accent on the first syllable and with the accent on the second syllable, respectively, but also, when two words of "bokuno (my)" and "tikakuno (near)" are successively written, the word storage section 400 stores the values of both the probabilities of pronouncing the combination of these successive words with the accent on the first syllable and with the accent on the second syllable, respectively. Besides them, the word storage section 400 also stores the value of the probability of pronouncing another combination of successive words with the accent on each syllable, when the word "bokuno (my)" and another word different from the word "tikakuno (near)" are successively written.

The information on the notations, reading ways and probability values stored in the word storage section 400 is generated by firstly recognizing the speech of target voice date recorded in advance, and then by counting the frequency, at which each combination of reading ways appears, for each combination of words. In other words, a higher probability value is stored for a combination of a word and a reading way that appear at a higher frequency in the target voice data. Note that it is preferable that the phoneme segment storage section 20 stores the information on parts-of-speech of words for the purpose of further enhancing the accuracy in speech synthesis. The information on parts-of-speech may also be generated through the speech recognition of the target voice data or may be given manually to the text data obtained through speech recognition.

The word search section 410 searches the word storage section 400 for a word having a notation matching with that of each of words contained in the inputted text, and generates the reading way of the text by reading the reading ways that correspond to the respective searched-out words from the word storage section 400, and then by connecting the reading ways to each other. For example, in the bi-gram model, while scanning the inputted text from the beginning, the word search section 410 searches the word storage section 400 for a combination of words matching with each combination of two successive words in the inputted text. Then, from the word storage section 400, the word search section 410 reads the combinations of reading ways corresponding to the searched-out combinations of words together with the probability values corresponding thereto. In this way, the word search section 410 retrieves multiple probability values each corresponding to a combination of words, from the beginning to the end of the text.

For example, in a case where the text contains words A, B and C in this order, a combination of a1 and b1 (a probability value p1), a combination of a2 and b1 (a probability value p2), a combination of a1 and b2 (a probability value p3) and a combination of a2 and b2 (a probability value p4) are retrieved as the reading ways of a combination of the words A and B. Similarly, a combination of b1 and c1 (a probability value p5), a combination of b1 and c2 (a probability value p6), a combination of b2 and c1 (a probability value p7) and a combination of b2 and c2 (a probability value p8) are retrieved as the reading ways of a combination of the words B and C. Then, the word search section 410 selects the combination of reading ways having the greatest products of the probability values of the respective combinations of words, and outputs the selected combination of reading ways to the phoneme segment search section 420 as the reading way of the text. In this example, the products of p1×p5, p1×p7, p2×p5, p2×p7, p3×p6, p3×p8, p4×p6 and p4×p8 are calculated individually, and the combination of reading ways corresponding to the combinations having the greatest product is outputted.

Next, the phoneme segment search section 420 figures out target prosody and tone for each phoneme based on the generated reading way, and retrieves the phoneme segment data piece that are the closest to the figured-out target prosody and tone, from the phoneme segment storage section 20. Thereafter, the phoneme segment search section 420 generates voice data by connecting the multiple retrieved phoneme segment data pieces to each other, and outputs the voice data to the computing section 320. For example, in a case where the generated reading way indicates a series of accents LHHHLLH (L denotes a low accent while H denotes a high accent) on the respective syllables, the phoneme segment search section 420 computes the prosodies of phonemes so that the series of low and high accents are expressed smoothly. The prosody is expressed with a change of a fundamental frequency and the length and volume of speech, for example. The fundamental frequency is computed by using a fundamental frequency model that is statistically learned in advance from voice data recorded by an announcer. With the fundamental frequency model, the target value of the fundamental frequency for each phoneme can be determined according to an accent environment, a part-of-speech and the length of a sentence. The above description gives only one example of the processing of figuring out a fundamental frequency from accents. Additionally, the tone, the length of duration and the volume of each phoneme can be also determined from the pronunciation through similar processing in accordance with rules that are statistically learned in advance. Here, more detailed description is omitted for the technique of determining the prosody and tone of each phoneme based on the accent and the pronunciation, since this technique has been known heretofore as a technique of predicting prosody or tone.

FIG. 5 shows an example of the data structure of the paraphrase storage section 340. The paraphrase storage section 340 stores multiple second notations that are paraphrases of multiple first notations while associating the second notations with the respective first notations. Moreover, in association with each of pairs of the first notations and the second notations, the paraphrase storage section 340 stores an similarity score indicating how similar the meaning of the second notation is to that of the first notation. For example, the paraphrase storage section 340 stores a first notation "bokuno (my)" in association with a second notation "watasino (my)" that is a paraphrase of the first notation, and further stores an similarity score "65%" in association with the combination of these notations. As shown in this example, the similarity score is expressed by percent, for example. In addition, the similarity score may be inputted by an operator who registers the notation in the paraphrase storage section 340, or computed based on the probability that users permit the replacement using this paraphrase as a result of the replacement processing.

When a large number of notations are registered in the paraphrase storage section 340, multiple identical first notations are sometimes stored in association with multiple different second notations. Specifically, there is a case where the replacement section 350 finds multiple first notations each matching with a notation in an inputted text as a result of comparing the inputted text with the first notations stored in the paraphrase storage section 340. In such a case, the replacement section 350 replaces the notation in the text with the second notation corresponding to the first notation having the highest similarity score among the multiple first notations. In this way, the similarity scores stored in association with the notations can be used as indicators for selecting a notation to be used for replacement.

Moreover, it is preferable that the second notations stored in the paraphrase storage section 340 be notations of words in the text representing the content of target voice data. The text representing the content of the target voice data may be a text read aloud to make a speech for generating the target voice data, for example. Instead, in a case where the target voice data is obtained from a speech which is made freely, the text may be a text indicating a result of the speech recognition of the target voice data or be a text manually written by dictating the content of the target voice data. By using such text, the notations of words are replaced with those used in the target voice data, and thereby the synthetic speech outputted for the text after the replacement can be made even more natural.

In addition to this, when multiple second notations corresponding to a first notation in the text is found, the replacement section 350 may compute, for each of the multiple second notations, a distance between the text obtained by replacing the notation in the inputted text with the second notation, and the text representing the content of the target voice data. The distance, here, is a concept known as a score indicating the degree at which these two texts are similar to each other in terms of the tendency of expression and the tendency of the content, and can be computed by using an existing method. In this case, the replacement section 350 selects the text having the shortest distance as the replacement text. By using this method, the speech based on the text can be approximated as close as possible to the target speech, after the replacement.

Figure 6:
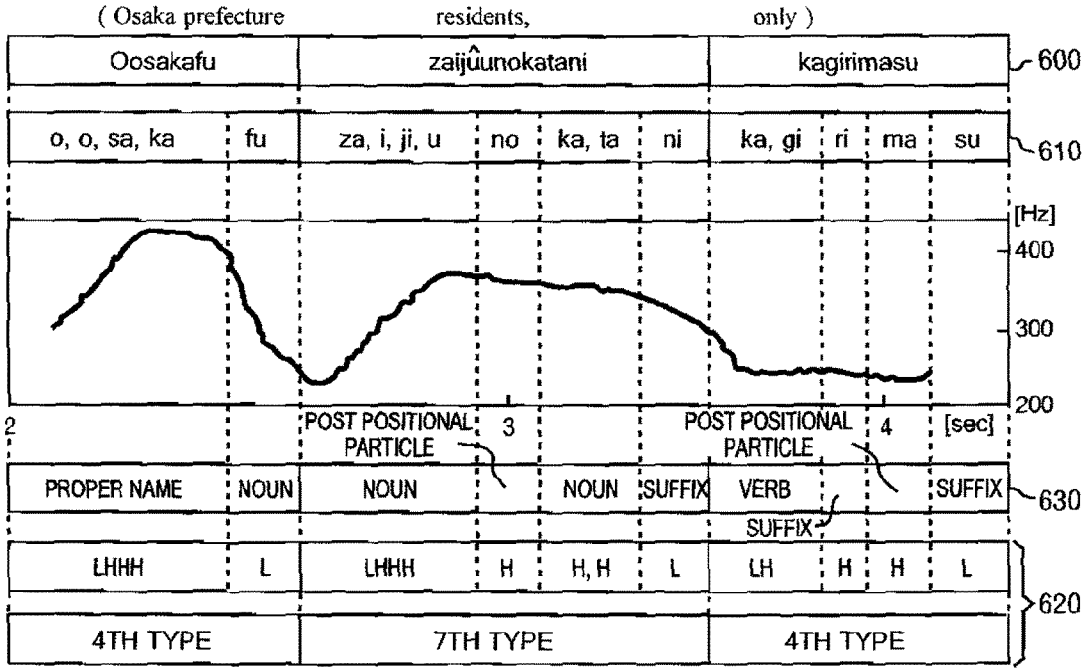
FIG. 6 shows an example of a data structure of a word storage section 400.

FIG. 6 shows an example of the data structure of the word storage section 400. The word storage section 400 stores word data 600, phonetic data 610, accent data 620 and part-of-speech data 630 in association with each other. The word data 600 represent the notation of each of multiple words. In the example shown in FIG. 6, the word data 600 contain the notations of multiple words of "Oosaka," "fu," "zaijyû," "no," "kata," "ni," "kagi," "ri," "ma" and "su" (Osaka prefecture residents, only) Moreover, the phonetic data 610 and the accent data 620 indicate the reading way of each of the multiple words. The phonetic data 610 indicate the phonetic transcriptions in the reading way and the accent data 620 indicate the accents in the reading way. The phonetic transcriptions are expressed, for example, by phonetic symbols using alphabets and the like. The accents are expressed by arranging a relative pitch level of voice, a high (H) or low (L) level, for each of phonemes in the speech. Moreover, the accent data 620 may contain accent models each corresponding to a combination of such high and low pitch levels of phonemes and each being identifiable by a number. In addition, the word storage section 400 may store the part-of-speech of each word as shown as the part-of-speech data 630. The part-of-speech does not mean a grammatically strict one, but includes a part-of-speech extensionally defined as one suitable for the speech synthesis and analysis. For example, the part-of-speech may include a suffix that constitutes the tail-end part of a phrase.

In comparison with the foregoing types of data, a central part of FIG. 6 shows speech waveform data generated based on the foregoing types of data by the word search section 410. More precisely, when the text of "Oosakafu zaijyûnokatani kagirimasu (Osaka prefecture residents only)" is inputted, the word search section 410 obtains a relative high or low pitch level (H or L) for each phoneme and the phonetic transcription (a phonetic symbol using the alphabet) of each phoneme with the method using the n-gram model. Then, the phoneme segment search section 420 generates a fundamental frequency that changes smoothly enough to make the synthetic speech not sound unnatural to the users, while reflecting the relative high and low pitch levels of phonemes. The central part of FIG. 6 shows one example of the fundamental frequency thus generated. The frequency changing in this way is ideal. However, in some cases, a phoneme segment data piece completely matching with the value of the frequency cannot be searched out from the phoneme segment storage section 20. As a result, the resultant synthetic speech may sound unnatural. To cope with such a case, as has been described, the speech synthesizer system 10 uses the retrievable phoneme segment data pieces effectively by paraphrasing the text, itself, to the extent that the meaning is not changed. In this way, the quality of synthetic speech can be improved.

Figure 7:
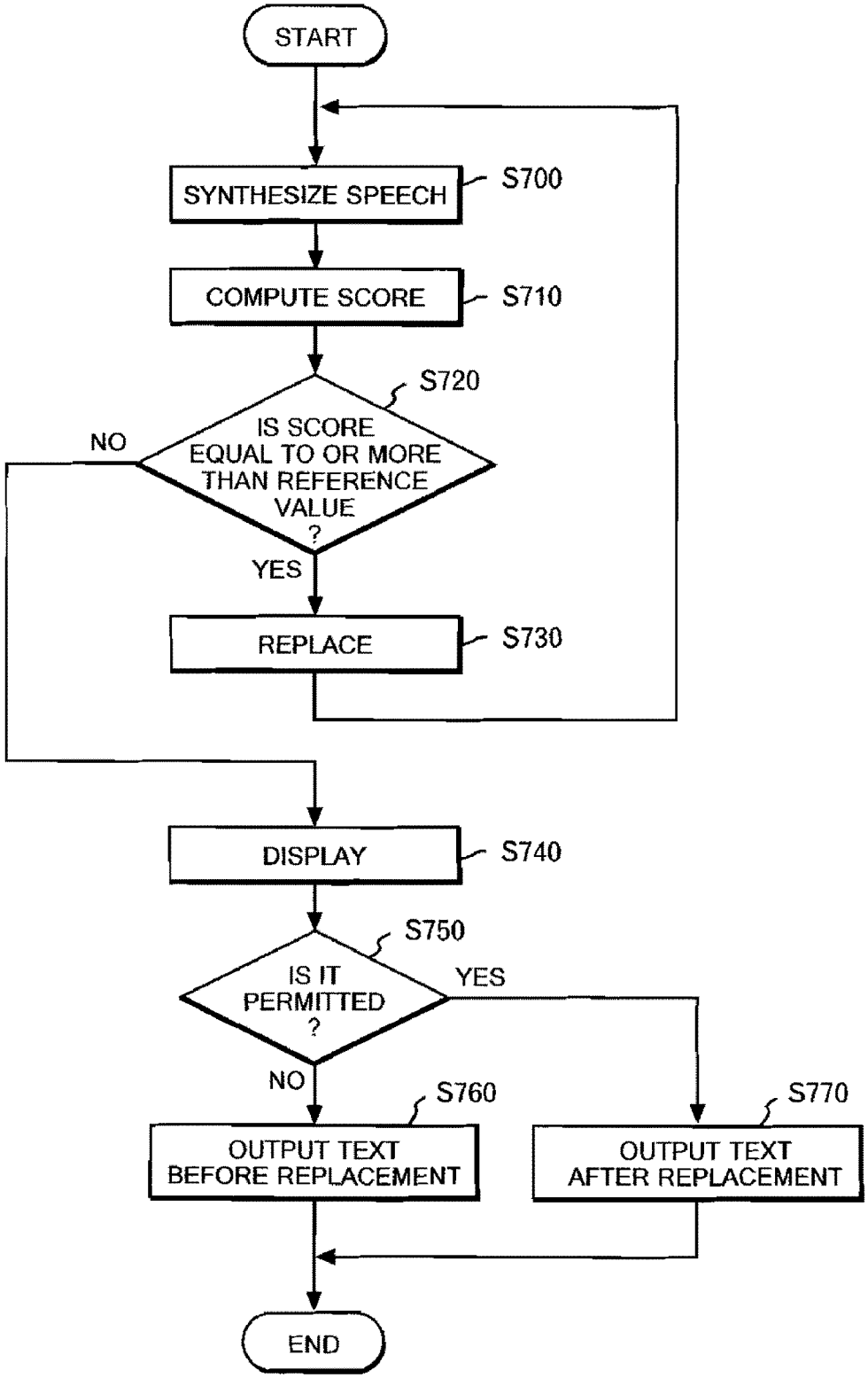
FIG. 7 shows a flowchart of the processing in which the speech synthesizer system 10 generates a synthetic speech.

FIG. 7 shows a flowchart of the processing through which the speech synthesizer system 10 generates synthetic speech. When receiving an inputted text from the outside, the synthesis section 310 reads, from the phoneme segment storage section 20, the phoneme segment data pieces corresponding to the respective phonemes representing the pronunciation of the inputted text, and then connects the phoneme segment data pieces to each other (S700). More specifically, the synthesis section 310 firstly performs a morphological analysis on the inputted text, and thereby detects boundaries between words included in the text, and a part-of-speech of each word. Thereafter, by using the data stored in advance in the word storage section 400, the synthesis section 310 finds which sound frequency and tone should be used to pronounce each phoneme when this text is read aloud. Then, the synthesis section 310 reads, from the phoneme segment storage section 20, the phoneme segment data pieces that are close to the found frequencies and tones, and connects the data pieces to each other. Thereafter, to the computing section 320, the synthesis section 310 outputs the connected data pieces as the voice data representing the synthetic speech of this text.

The computing section 320 computes the score indicating the unnaturalness of the synthetic speech of this text on the basis of the voice data received from the synthesis section 310 (S710). Here, an explanation is given for an example of this. The score is computed based on the degree of difference between the pronunciations of the phoneme segment data pieces at the connection boundary thereof, the degree of difference between the pronunciation of each phoneme based on the reading way of the text, and the pronunciation of a phoneme segment data piece retrieved by the phoneme segment search section 420. More detailed descriptions thereof will be given below in sequence.

(1) Degree of Difference Between Pronunciations at a Connection Boundary

The computing section 320 computes the degree of difference between basic frequencies and the degree of difference between tones at each of the connection boundaries of phoneme segment data pieces contained in the voice data. The degree of difference between the basic frequencies may be a difference value between the basic frequencies, or may be a change rate of the fundamental frequency. The degree of difference between tones is the distance between a vector representing a tone before the boundary and a vector representing a tone after the boundary. For example, the difference between tones may be a Euclidean distance, in a cepstral space, between vectors obtained by performing the discrete cosine transform on the speech waveform data before and after the boundary. Then, the computing section 320 sums up the degrees of differences of the connection boundaries.

When a voiceless consonant such as p or t is pronounced at a connection boundary of phoneme segment data pieces, the computing section 320 judges the degree of difference at the connection boundary as 0. This is because a listener is unlikely to feel the unnaturalness of speech around the voiceless consonant, even when the tone and fundamental frequency largely change. For the same reason, the computing section 320 judges the difference at a connection boundary as zero when a pause mark is contained at the connection boundary in the phoneme segment data pieces.

(2) Degree of Difference Between Pronunciation Based on a Reading Way and Pronunciation of a Phoneme Segment Data Piece For each phoneme segment data piece contained in the voice data, the computing section 320 compares the prosody of the phoneme segment data piece with the prosody determined based on the reading way of the phoneme. The prosody may be determined based on the speech waveform data representing the fundamental frequency. For example, the computing section 320 may use the total or average of frequencies of each speech waveform data for such comparison. Then, the difference value between them is computed as the degree of difference between the prosodies. Instead of this, or in addition to this, the computing section 320 compares vector data representing the tone of each phoneme segment data piece with vector data determined based on the reading way of each phoneme. Thereafter, as the degree of difference, the computing section 320 computes the distance between these two vector data in terms of the tone of the front-end or back-end part of the phoneme. Besides this, the computing section 320 may use the length of the pronunciation of a phoneme. For example, the word search section 410 computes a desirable value as the length of the pronunciation of each phoneme on the basis of the reading way of each phoneme. On the other hand, the phoneme segment search section 420 retrieves the phoneme segment data piece representing the length closest to the length of the desirable value. In this case, the computing section 320 computes the difference between the lengths of these pronunciations as the degree of difference.

As the score, the computing section 320 may obtain a value by summing up the degrees of differences thus computed, or obtain a value by summing up the degrees of differences while assigning weights to these degrees. In addition, the computing section 320 may input each of the degrees of difference to a predetermined evaluation function, and then use the outputted value as the score. In essence, the score can be any value as long as the value indicates the difference between the pronunciations at a connection boundary and the difference between the pronunciation based on the reading way and the pronunciation based on the phoneme segment data.

The judgment section 330 judges whether or not the score thus computed is equal to or greater than the predetermined reference value (S720). If the score is equal to or greater than the reference value (S720: YES), the replacement section 350 searches the text for a notation matching with any of the first notations by comparing the text with the paraphrase storage section 340 (S730). After that, the replacement section 350 replaces the searched-out notation with the second notation corresponding to the first notation.

The replacement section 350 may target all the words in the text as candidates for replacement and may compare all of them with the first notations. Alternatively, the replacement section 350 may target only a part of the words in the text for such comparison. It is preferable that the replacement section 350 should not target a part of sentences in the text even when a notation matching with the first notation is found out in the part of sentences. For example, the replacement section 350 does not replace any notation for a sentence containing at least one of a proper name and a numeral value, but retrieves a notation matching with the first notation for sentences not containing a proper name or a numeral value. In a case of a sentence containing a numeral value and a proper name, more severe strictness in the meaning is often required. Accordingly, by excluding such sentences from the target for replacement, the replacement section 350 can be prevented from changing the meaning of such a sentence.

In order to make the processing more efficient, the replacement section 350 may compare only a certain part of the text for replacement, with the first notations. For example, the replacement section 350 sequentially scans the text from the beginning, and sequentially selects combinations of a predetermined number of words successively written in the text. Assuming that a text contains words A, B, C, D and E and that the predetermined number is 3, the replacement section 350 selects words ABC, BCD and CDE in this order. Then, the replacement section 350 computes a score indicating the unnaturalness of each of the synthetic speeches corresponding to the selected combinations.

More specifically, the replacement section 350 sums up the degrees of differences between the pronunciations at connection boundaries of phonemes contained in each of the combinations of words. Thereafter, the replacement section 350 divides the total sum by the number of connection boundaries contained in the combination, and thus figures out the average value of the degree of difference at each connection boundary. Moreover, the replacement section 350 adds up the degrees of difference between the synthetic speech and the pronunciation based on the reading way corresponding to each phoneme contained in the combination, and then obtains the average value of the degree of difference per phoneme by dividing the total sum by the number of phonemes contained in the combination. Moreover, as the scores, the replacement section 350 computes the total sum of the average value of the degree of difference per connection boundary, and the average value of the degree of difference per phoneme. Then, the replacement section 350 searches the paraphrase storage section 340 for a first notation matching with the notation of any of words contained in the combination having the largest computed scores. For instance, if the score of BCD is the largest among ABC, BCD and CDE, the replacement section 350 selects BCD and retrieves a word in BCD matching with any of the first notations.

In this way, the most unnatural portion can preferentially be targeted for replacement and thereby the entire replacement processing can be made more efficient.

Subsequently, the judgment section 330 inputs the text after the replacement to the synthesis section 310 in order for the synthesis section 310 to further generate voice data of the text, and returns the processing to S700. On the other hand, on condition that the score is less than the reference value (S720: NO), the display section 335 shows the user this text having the notation replaced (S740). Then, the judgment section 330 judges whether or not an input permitting the replacement in the displayed text is received (S750). On condition that the input permitting the replacement is received (S750: YES), the judgment section 330 outputs the voice data based on this text having the notation replaced (S770). In contrast, on condition that the input not permitting the replacement is received (S750: NO), the judgment section 330 outputs the voice data based on the text before the replacement no matter how great the score is (S760). In response to this, the output section 370 outputs the synthetic speech.

FIG. 8 shows specific examples of texts sequentially generated in a process of generating synthesized speech by the speech synthesizer system 10. A text 1 is a text "Bokuno sobano madono dehurosutao tuketekureyo (Please turn on a defroster of a window near me)." Even though the synthesis section 310 generates the voice data based on this text, the synthesized speech has an unnatural sound, and the score is greater than the reference value (for example, 0.55). By replacing "dehurosuta (defroster)" with "dehurosutâ (defroster)," a text 2 is generated. Since even the text 2 still has the score greater than the reference value, a text 3 is generated by replacing "soba (near)" with "tikaku (near)." Thereafter, similarly, by replacing "bokuno (me)" with "watasino (me)," replacing "kureyo (please)" with "chôdai (please)," and further replacing "chôdai (please)" with "kudasai (please)," a text 6 is generated. As shown in the last replacement, a word that has been replaced once can be again replaced with another notation.

Since even the text 6 still has the score greater than the reference value, the word "madono (window)" is replaced with "madono, (window)." In this way, words before replacement or after replacement (that is, the foregoing first and second notations) may each contain a pause mark (a comma). In addition, the word "dehurosutâ (defroster)" is replaced with "dehoggâ (defogger)." A text 8 consequently generated has the score less than the reference value. Accordingly, the output section 370 outputs the synthetic speech based on the text 8.

Figure 9:
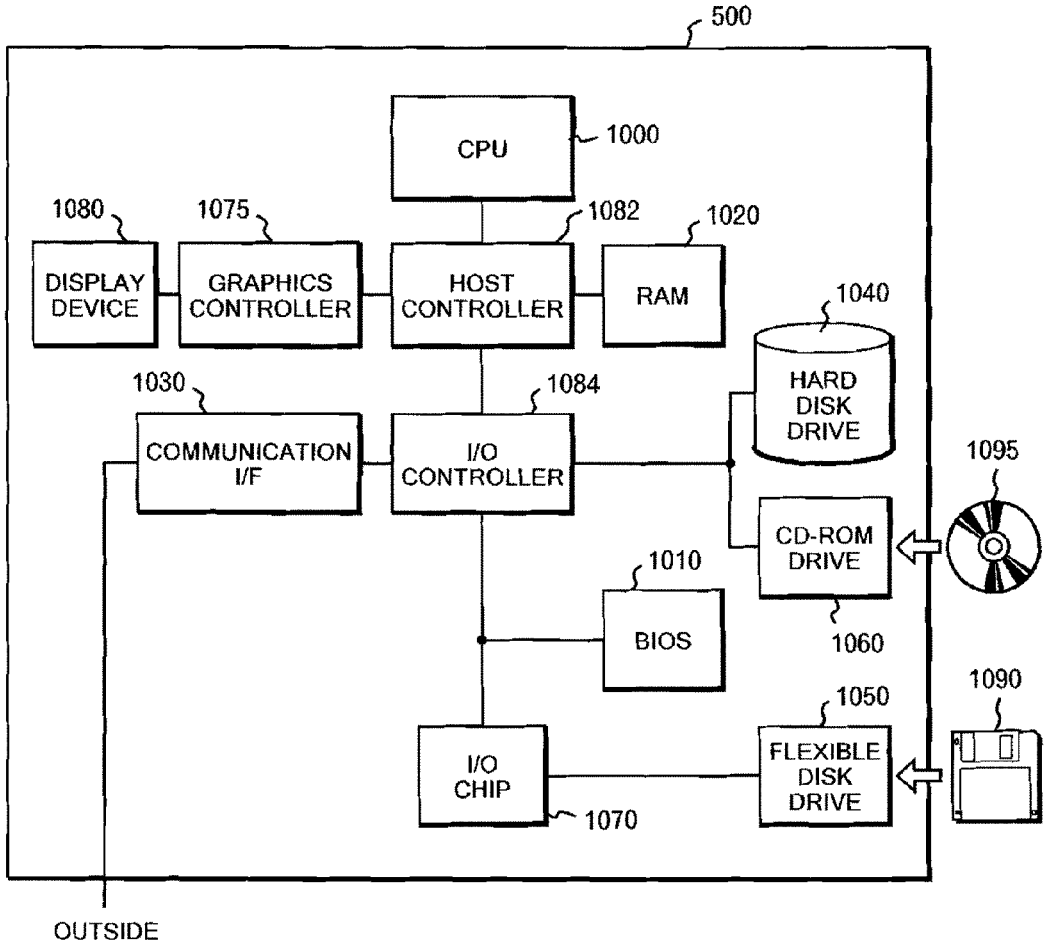
FIG. 9 shows an example of a hardware configuration of an information processing apparatus 500 functioning as the speech synthesizer system 10.

FIG. 9 shows an example of a hardware configuration of an information processing apparatus 500 functioning as the speech synthesizer system 10. The information processing apparatus 500 includes a CPU peripheral unit, an input/output unit and a legacy input/output unit. The CPU peripheral unit includes the CPU 1000, the RAM 1020 and the graphics controller 1075, all of which are connected to one another via a host controller 1082. The input/output unit includes a communication interface 1030, the hard disk drive 1040 and a CD-ROM drive 1060, all of which are connected to the host controller 1082 via an input/output controller 1084. The legacy input/output unit includes a ROM 1010, a flexible disk drive 1050 and the input/output chip 1070, all of which are connected to the input/output controller 1084.

The host controller 1082 connects the RAM 1020 to the CPU 1000 and the graphics controller 1075, both of which access the RAM 1020 at a high transfer rate. The CPU 1000 is operated according to programs stored in the ROM 1010 and the RAM 1020, and controls each of the components. The graphics controller 1075 obtains image data generated by the CPU 1000 or the like in a frame buffer provided in the RAM 1020, and causes the obtained image data to be displayed on a display device 1080. Instead, the graphics controller 1075 may internally include a frame buffer that stores the image data generated by the CPU 1000 or the like.

The input/output controller 1084 connects the host controller 1082 to the communication interface 1030, the hard disk drive 1040 and the CD-ROM drive 1060, all of which are higher-speed input/output devices. The communication interface 1030 communicates with an external device via a network. The hard disk drive 1040 stores programs and data to be used by the information processing apparatus 500. The CD-ROM drive 1060 reads a program or data from a CD-ROM 1095, and provides the read-out program or data to the RAM 1020 or the hard disk drive 1040.

Moreover, the input/output controller 1084 is connected to the ROM 1010 and lower-speed input/output devices such as the flexible disk drive 1050 and the input/output chip 1070. The ROM 1010 stores programs, such as a boot program executed by the CPU 1000 at a start-up time of the information processing apparatus 500, and a program that is dependent on hardware of the information processing apparatus 500. The flexible disk drive 1050 reads a program or data from a flexible disk 1090, and provides the read-out program or data to the RAM 1020 or hard disk drive 1040 via the input/output chip 1070. The input/output chip 1070 is connected to the flexible disk drive 1050 and various kinds of input/output devices with, for example, a parallel port, a serial port, a keyboard port, a mouse port and the like.

A program to be provided to the information processing apparatus 500 is provided by a user with the program stored in a recording medium such as the flexible disk 1090, the CD-ROM 1095 and an IC card. The program is read from the recording medium via the input/output chip 1070 and/or the input/output controller 1084, and is installed on the information processing apparatus 500. Then, the program is executed. Since an operation that the program causes the information processing apparatus 500 to execute is identical to the operation of the speech synthesizer system 10 described by referring to FIGS. 1 to 8, the description thereof is omitted here.

The program described above may be stored in an external storage medium. In addition to the flexible disk 1090 and the CD-ROM 1095, examples of the storage medium to be used are an optical recording medium such as a DVD or a PD, a magneto-optic recording medium such as an MD, a tape medium, and a semiconductor memory such as an IC card. Alternatively, the program may be provided to the information processing apparatus 500 via a network, by using, as a recording medium, a storage device such as a hard disk and a RAM, provided in a server system connected to a private communication network or the Internet.

As has been described above, the speech synthesizer system 10 of this embodiment is capable of searching out notations in a text that make a combination of phoneme segments sound more natural by sequentially paraphrasing the notations to the extent that the meanings thereof are not largely changed, and thereby of improving the quality of synthetic speech. In this way, even when the acoustic processing such as the processing of combining phonemes or of changing frequency has limitations on the improvement of the quality, the synthetic speech with much higher quality can be generated. The quality of the speech is accurately evaluated by using the degree of difference between the pronunciations at connection boundaries between phonemes and the like. Thereby, accurate judgments can be made as to whether or not to replace notations and which part in a text should be replaced.

Hereinabove, the present invention has been described by using the embodiment. However, the technical scope of the present invention is not limited to the above-described embodiment. It is obvious to one skilled in the art that various modifications and improvements may be made to the embodiment. It is also obvious from the scope of claims of the present invention that thus modified and improved embodiments are included in the technical scope of the present invention.

The invention claimed is:

1. A system for generating synthetic speech, comprising:

a phoneme segment storage section operable to store a plurality of phoneme segment data pieces indicating a plurality of sounds of phonemes which are different from each other; and a synthesis section operable to generate voice data representing synthetic speech of text by receiving an inputted text, reading out phoneme segment data pieces that correspond to respective phonemes indicating the pronunciation of the inputted text, and connecting the read-out phoneme segment data pieces to each other;

a computing section operable to compute a score indicating naturalness of the synthetic speech of the text, on the basis of the voice data;

a paraphrase storage section operable to store a plurality of notations each comprising a word or phrase, the plurality of notations comprising a plurality of first notations and a plurality of second notations, each second notation being a paraphrase of a respective first notation;

a replacement section operable to search the text for a notation matching any of the first notations and to replace a matching notation with the second notation corresponding to the first notation; and a judgment section operable to receive the score computed by the computing section and determine whether the score indicates the synthetic speech is sufficiently natural, and:

if the score indicates the synthetic speech is sufficiently natural, output the generated voice data; and if the score indicates the synthetic speech is not sufficiently natural, cause the replacement section to generate revised text by replacing at least one other notation in the inputted text matching a first notation with a corresponding second notation, and cause the synthesis section to generate voice data for the revised text.

2. The system according to claim 1, wherein the computing section is operable to compute, as the score, a degree of difference in pronunciation between first and second phoneme segment data pieces contained in the voice data and connected to each other, at a boundary between the first and second phoneme segment data pieces.

3. The system according to claim 2, wherein:

the phoneme segment storage section is operable to store a data piece representing fundamental frequency and tone of the sound of each phoneme as the phoneme segment data piece, and the computing section is operable to compute, as the score, a degree of difference in the fundamental frequency and tone between the first and second phoneme segment data pieces at the boundary between the first and second phoneme segment data pieces.

4. The system according to claim 1, wherein:

the synthesis section includes:

a word storage section for storing a reading way of a plurality of words in association with a notation of the plurality of words;

a word search section for searching the word storage section for a word whose notation matches with the notation of each of the words contained in the inputted text, and for generating a reading way of the text by reading the reading ways corresponding to the respective searched-out words from the word storage section, and then by connecting the reading ways to each other; and a phoneme segment search section for generating the voice data by retrieving a phoneme segment data piece representing a prosody closest to a prosody of each phoneme determined based on the generated reading way, from the phoneme segment storage section, and then by connecting the plurality of retrieved phoneme segment data pieces to each other, and the computing section is operable to compute, as the score, a difference between the prosody of each phoneme determined based on the generated reading way, and a prosody indicated by the phoneme segment data piece retrieved in correspondence to each phoneme.

5. The system according to claim 1, wherein the synthesis section includes:

a word storage section for storing a reading way of a plurality of words in association with a notation of the plurality of words;

a word search section for searching the word storage section for a word whose notation matches with the notation of each of the words contained in the inputted text, and for generating a reading way of the text by reading the reading ways corresponding to the respective searched-out words from the word storage section, and then by connecting the reading ways to each other;

a phoneme segment search section for generating the voice data by retrieving a phoneme segment data piece representing a tone closest to tone of each phoneme determined based on the generated reading way, from the phoneme segment storage section, and then by connecting the plurality of retrieved phoneme segment data pieces to each other, and wherein the computing section is operable to compute, as the score, a difference between the tone of each phoneme determined based on the generated reading way, and the tone indicated by the phoneme segment data piece retrieved in correspondence to each phoneme.

6. The system according to claim 1, wherein:

the phoneme segment storage section is operable to store obtained target voice data that is target speaker's voice data to be targeted for synthetic speech generation, and to generate and store a plurality of phoneme segment data pieces representing sounds of a plurality of phonemes contained in the target voice data, the paraphrase storage section is operable to store, as each of the plurality of second notations, the notation of a word contained in a text representing the content of the target voice data, and the replacement section is operable to replace a notation contained in the inputted text which matches any of the first notations, with a corresponding one of the second notations that is a notation representing content of target voice data.

7. The system according to claim 1, wherein:

the replacement section is operable to search the text for combinations of a predetermined number of words successively written in the inputted text, in which any match a first notation, and replaces a word contained in the combination having a greatest degree of difference between included words with a corresponding second notation.

8. The system according to claim 1, wherein:

the paraphrase storage section is operable to store a similarity score in association with each of combinations of a first notation and a second notation that is a paraphrase of the first notation, the similarity score indicating a degree of similarity between meanings of the first and second notations, and when a notation contained in the inputted text matches with each of a plurality of first notations, the replacement section replaces the matching notation with the second notation having a highest similarity to the corresponding first notation.

9. The system according to claim 1, wherein:

the replacement section is operable to not replace a notation included in a sentence that contains at least any one of a proper name and a numeral value.

10. The system according to claim 1, further comprising a display section operable to display the text, having the notation replaced, to a user on condition that the replacement section replaces the notation, and wherein the judgment section is operable to output voice data based on the text having the notation replaced, if an input permitting the replacement in the displayed text is received, and outputs voice data based on the text before replacement if an input permitting the replacement in the displayed text is not received.

11. A method for generating synthetic speech, comprising acts of:

storing a plurality of phoneme segment data pieces indicating a plurality of sounds of phonemes different from each other;

generating voice data representing synthetic speech of text by receiving an inputted text, reading out the phoneme segment data pieces corresponding to respective phonemes indicating the pronunciation of the inputted text, and connecting the read-out phoneme segment data pieces to each other;

computing a score indicating naturalness of the synthetic speech of the text, on the basis of the voice data;

storing a plurality of notations each comprising a word or phrase, the plurality of notations comprising a plurality of first notations and a plurality of second notations, each second notation being a paraphrase of a respective first notation;

searching the text for a notation matching any of the first notations, and replacing a matching notation with the second notation corresponding to the first notation;

determining whether the score indicates that the synthetic speech is sufficiently natural; and if the score indicates that the synthetic speech is sufficiently natural, outputting the generated voice data; and if the score indicates that the synthetic speech is not sufficiently natural, generating revised text by replacing at least one other notation in the inputted text matching a first notation with a corresponding second notation, and generating voice data for the revised text.

12. At least one storage device having instructions encoded thereon which, when executed, perform a method of generating synthetic speech, the method comprising acts of:

storing a plurality of phoneme segment data pieces indicating a plurality of sounds of phonemes which are different from each other; and generating voice data representing synthetic speech of text by receiving an inputted text, reading out phoneme segment data pieces that correspond to respective phonemes indicating the pronunciation of the inputted text, and connecting the read-out phoneme segment data pieces to each other;

computing a score indicating naturalness of the synthetic speech of the text, on the basis of the voice data;

storing a plurality of notations each comprising a word or phrase, the plurality of notations comprising a plurality of first notations and a plurality of second notations, each of the second notations being a paraphrase of a respective first notation; and searching the text for a notation matching any of the first notations and replacing a matching notation with the second notation corresponding to the first notation; and determining whether the score indicates that the synthetic speech is sufficiently natural; and if the score indicates that the synthetic speech is sufficiently natural, outputting the generated voice data; and if the score indicates that the synthetic speech is not sufficiently natural, generating revised text by replacing at least one other notation in the inputted text matching a first notation with a respective second notation, and generating voice data for the revised text.

* * * * *

UNITED STATES PATENT AND TRADEMARK OFFICE

CERTIFICATE OF CORRECTION

PATENT NO. : 8,015,011 B2
APPLICATION NO. : 12/022333
DATED : September 6, 2011
INVENTOR(S) : Tohru Nagano et al.

It is certified that error appears in the above-identified patent and that said Letters Patent is hereby corrected as shown below:

Claim 7, column 15 at lines 43-50 should read:

7. The system according to claim 1, wherein:

the replacement section is operable to search the text for combinations of a predetermined number of words successively written in the inputted text[[,]] in which any match a first notation, and replaces a word contained in the combination having a greatest degree of difference between included words with a corresponding second notation.

Signed and Sealed this
Tenth Day of January, 2012

David J. Kappos

David J. Kappos
*Director of the United States Patent and Trademark Office*